United States Patent [19]

Platt et al.

[11] Patent Number: 4,467,627

[45] Date of Patent: Aug. 28, 1984

[54] PUMP FOR A DISPENSING SYSTEM FOR AN AUTOMATIC WASHER

[75] Inventors: Clark I. Platt, St. Joseph Township, Berrien County; James R. Hageman, Berrien Springs, both of Mich.

[73] Assignee: Whirlpool Corporation, Benton Harbor, Mich.

[21] Appl. No.: 450,348

[22] Filed: Dec. 16, 1982

[51] Int. Cl.[3] ..... D06F 39/02; D06F 39/08; F01D 1/30

[52] U.S. Cl. ..... 68/17 R; 68/184; 68/207; 68/208; 137/565; 415/152 A

[58] Field of Search ..... 137/565; 415/152 A; 68/12 R, 17 R, 23.5, 184, 207, DIG. 2, 208; 134/93, 100, 101, 155, 176, 186; 222/133

[56] References Cited

U.S. PATENT DOCUMENTS

| | | | |
|---|---|---|---|
| 2,838,002 | 5/1958 | Cohen | 415/152 A X |
| 2,883,843 | 4/1959 | Bochan | 68/184 X |
| 2,894,384 | 7/1959 | Smith | 68/23.5 X |
| 2,969,739 | 1/1961 | Clearman | 68/208 X |
| 4,091,644 | 5/1978 | Bochan | 415/152 A X |
| 4,188,807 | 2/1980 | Graf et al. | 68/17 R |

*Primary Examiner*—Philip R. Coe

*Attorney, Agent, or Firm*—Hill, Van Santen, Steadman & Simpson

[57] ABSTRACT

A pump for an automatic washer is provided which has an inlet connected to the machine tub and a first outlet connected to a set of dispensing chambers and a second outlet connected to a drain, and including a check valve between the inlet and the second outlet such that when the pump is rotated in a first direction, liquid is drawn from the tub through the check valve and pumped by the impeller to the first outlet. The first outlet is selectively openable and if opened by a solenoid controlled valve, allows a flow of liquid to the dispenser chambers. Rotation of the impeller in the second direction closes the check valve and allows the flow of liquid from the machine tub to the drain.

11 Claims, 6 Drawing Figures

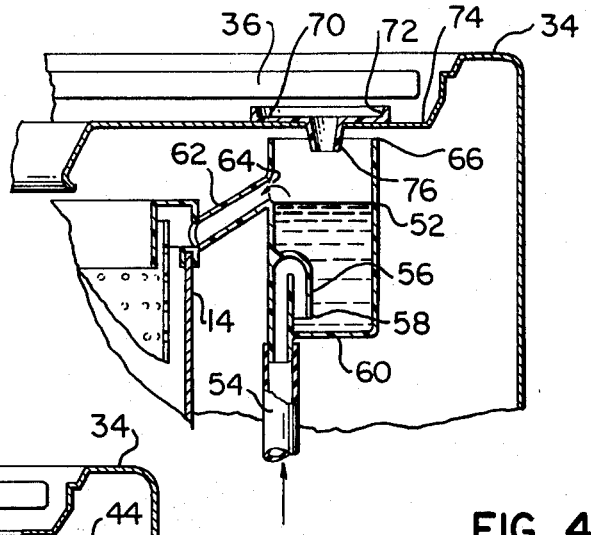
FIG 4
FIG 3
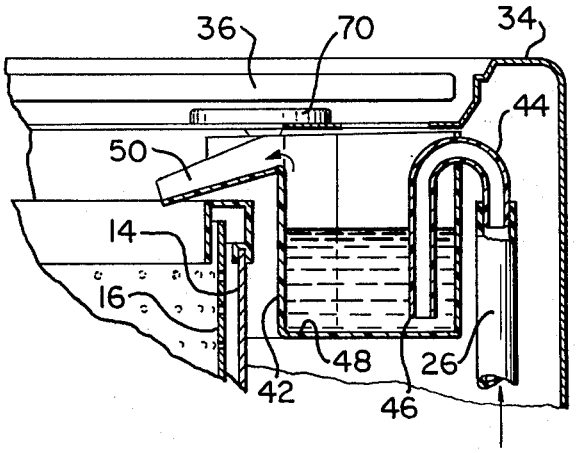
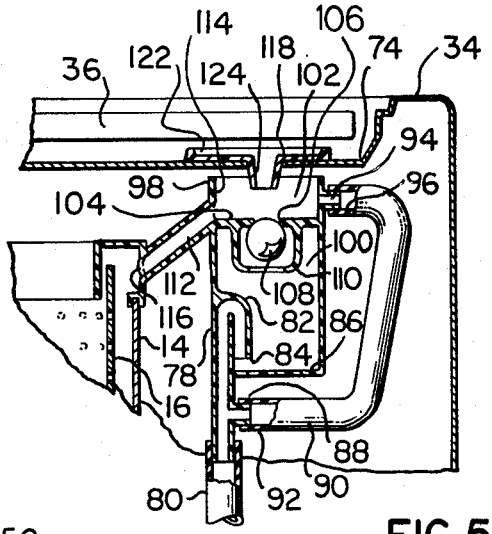
FIG 5
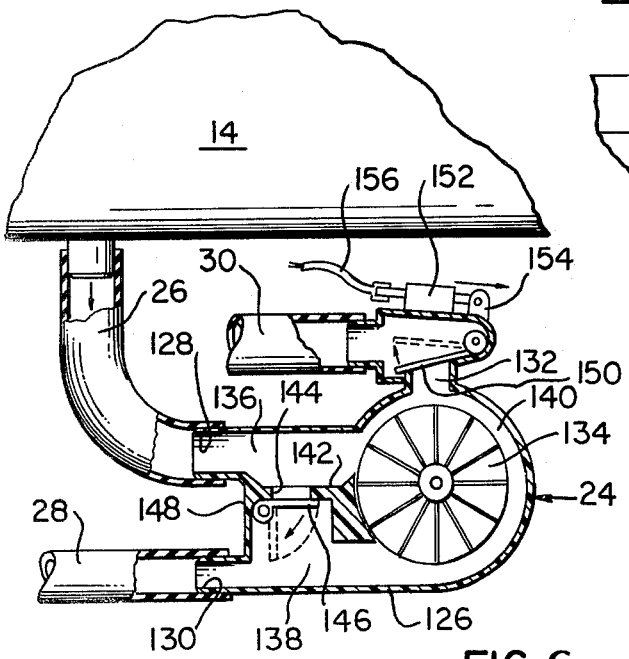
FIG 6

PUMP FOR A DISPENSING SYSTEM FOR AN AUTOMATIC WASHER

BACKGROUND OF THE INVENTION

1. Field of the Invention

This invention relates to an automatic washer pump for use in dispensing additives and more specifically to the automatic dispensing of multiple wash additives in an automatic clothes washing machine.

2. Description of the Prior Art

Reversible pumps which utilize various check valve members to automatically provide flow out of one of two exit ports depending on the direction of the rotation of the pump impeller have been used in automatic washing machines as shown by U.S. Pat. Nos. 2,838,002; 2,883,843 and 4,091,644. Also, utilizing a valve to interchange the inlet and outlet to a unidirectional impeller pump is known in the art as shown in U.S. Pat. No. 2,969,739.

SUMMARY OF THE INVENTION

The present invention includes a pump for an automatic washer which provides a water supply for actuating detergent, rinse additive and bleach dispensers in an automatic clothes washing machine. The detergent is washed or flushed out of the detergent chamber at the desired time, especially after a prewash cycle where a second wash cycle is desired to complete the machine cycle. The bleach is flushed into the wash bath at the same time as the detergent is put into the wash bath and the rinse additive chamber is filled with water at the same time that the detergent and the bleach are being dispensed into the wash bath. The rinse additive does not get dispensed until the spin or extract cycle is completed prior to deep rinse.

A water supply tap line from the pump supplying the dispensers is timer actuated through a solenoid valve which controls all of the dispensers by diverting the water from the pump to the right place in the dispenser at the proper time. The pump is mounted directly on the end of the washer motor and has an impeller which pumps water in a clockwise and a counterclockwise direction of rotation.

The pump has two valves which control the flow of water for the functions during a wash cycle. The two valves selectively open and close ports within the pump housing. One valve opens and closes a port at the desired times to allow water to be pumped into the dispenser hose tap line when the impeller is rotating in a counterclockwise direction (during the wash cycle). This valve is operated by a solenoid through a linkage.

A flapper check valve controls the flow of water coming from the tub through a recirculation hose also when the pump is operated in the counterclockwise direction. The flapper valve is pivoted on a pin and is free to pivot to the open or closed position depending on the water pressure within the pump housing.

The dispensing system from the machine includes three chambers which are water flushed clean and empty at the end of each complete machine cycle. Detergent, bleach and rinse additives are added through the top of the machine. After the tub is filled to the desired level, an agitation cycle begins, the pump starts and the impeller rotates in a counterclockwise direction. If the solenoid is actuated to open the valve, water is caused to flow from the tub down to the recirculation hose line to the pump and then up through the tap line.

This causes a flow of water into the detergent chamber which causes flooding of the chamber and the flow of water and detergent to overflow into the wash bath. The bleach chamber is filled at the same time and overflows into the tub through a bleed line. The rinse additive chamber is filled with water and blended with the rinse additive at the same time the water is added to the detergent and bleach chambers. A check valve closes when the rinse additive chamber becomes filled with liquid. Excess water bypasses the rinse additive chamber and is discharged into the basket and tub area.

The rinse additives, along with any residual water in the detergent or bleach chambers, are siphoned out of the chambers when the pump stops and the valve is opened by the solenoid. This would occur after the spin portion of the cycle, during the rinse fill period of the cycle and allows the rinse additives to come down the tap hose and blend with the water in the pump in lower tub area during the rinse fill period. The valve would then be closed for the remainder of the wash cycle.

The present invention provides an improvement over the prior art in that it provides a pump for an automatic washer having an inlet from the machine tub and a first outlet to a set of dispensers and a second outlet to a drain, and including a check valve between the inlet and the second outlet such that when the pump is rotated in a first direction liquid is drawn from the tub through the check valve and pumped by the impeller to the first outlet which, if opened by a solenoid controlled valve, allows flow of liquid to the dispensers, and rotation of the impeller in the opposite direction closes the check valve to allow the flow of liquid from the machine tub out the second outlet to the drain.

DESCRIPTION OF THE DRAWINGS

FIG. 3 is a partial sectional view of the detergent additive chamber taken generally along the lines III—III of FIG. 2.

FIG. 4 is a partial sectional view of the bleach additive chamber taken generally along the lines IV—IV of FIG. 2.

FIG. 5 is a partial sectional view of the rinse additive chamber taken generally along the lines V—V of FIG. 2.

FIG. 6 is a partial sectional view of the pump utilized in the present invention.

DESCRIPTION OF THE PREFERRED EMBODIMENTS

Figure 1:
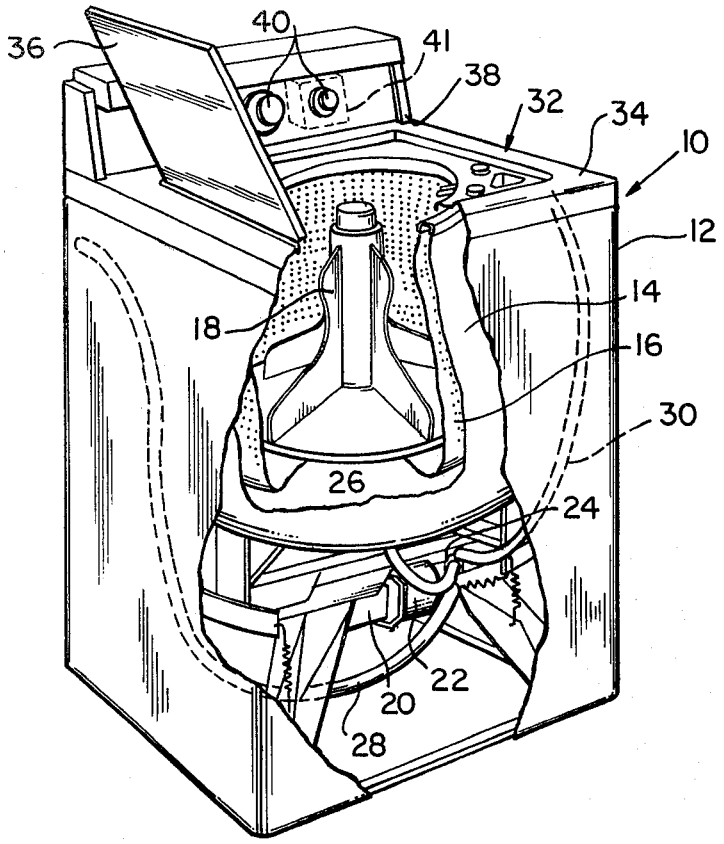
FIG. 1 is a perspective view of an automatic clothes washing machine partially cut away showing the interior mechanism.

In FIG. 1 there is shown a washing machine generally at 10 which includes a cabinet 12 enclosing a wash tub 14, a wash basket 16 and a vertically mounted agitator 18. The agitator 18 is connected via a transmission 20 to an electric motor 22. The motor 22 also operates a pump 24. The pump 24 is connected by a recirculation conduit 26 to the interior of the wash tub 14, by a drain conduit 28 to drain and by a tap line conduit 30 to dispensing system chambers shown generally at 32. The washing machine cabinet 12 has a top horizontal surface 34 with a hinged lid 36 which opens to provide access to the interior of the tub 14 and basket 16 and also to the dispensing system chambers 32.

The top of the washing machine 10 also has a console 38 on which are mounted controls 40 including conventional sequential timing controls 41 capable of operating the machine through a sequence of washing, rinsing and spin drying steps.

Figure 2:
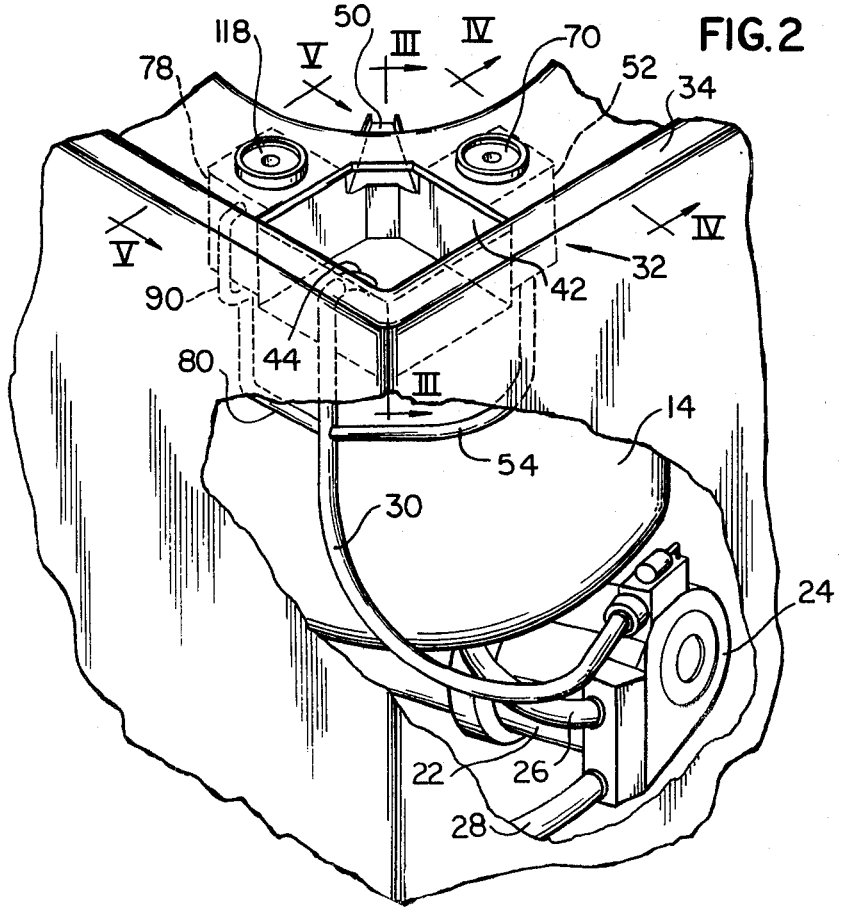
FIG. 2 is a partial perspective view of the washer showing the location of the pump and dispensing apparatus.

The dispensing system chambers 32 are seen in greater detail in FIG. 2 where it is seen that there are provided three separate chambers for containing wash liquid additives. A first chamber 42 is a detergent dispensing chamber which is also shown in cross section in FIG. 3. The tap line conduit 30 from the pump 24 is connected to a U tube 44 which has an end 46 projecting into the interior of the detergent chamber 42 and is positioned just above a bottom wall 48 of the chamber 42. The detergent chamber 42 has an open top providing access to the interior of the chamber and has an overflow spout 50 leading from a point near the top of the chamber 42 and extending into the interior of the tub 14 and basket 16 such that any overflow from the detergent chamber 42 will enter the interior of the wash basket 16.

A second chamber 52 comprises a bleach chamber which is also seen in FIG. 4. The bleach chamber 52 receives a supply of wash liquid through tap line conduit 30 and a connecting conduit 54 which attaches to a U tube 56 having an open end 58 communicating with the interior of the bleach chamber 52 and is positioned just above a bottom wall 60 of the chamber. A bleed line conduit 62 communicates through an opening 64 near a top end 66 of the bleach chamber 52 at one end and an opening 68 in the tub 14 such that any overflow from the bleach chamber 52 will flow through line 62 into the tub 14.

The top 66 of the bleach chamber 52 is open and a funnel member 70 is provided which has a wide mouth area 72 mounted above a recessed portion 74 of the top cabinet wall 34 and a narrow nozzle 76 projecting through an opening in the wall 74 into the interior of the bleach chamber 52.

A third chamber 78 is a rinse additive chamber which is also seen in FIG. 5. The rinse additive chamber 78 receives a supply of wash liquid from the tap line 30 and a connecting conduit 80 which is connected to a U tube 82 having an open end 84 communicating with the interior of the chamber 78 and is positioned just above a bottom wall 86 of the rinse additive chamber 78. The U tube 82 has a perpendicular leg 88 between the open end 84 and the connection with the connecting conduit 80. A bypass conduit 90 is attached to the leg 88 at a first end 92 and a second end 94 is attached to a nipple 96 communicating with the interior of the rinse additive chamber 78 near a top end 98 of the chamber.

The interior of the rinse additive chamber 78 is divided into two compartments, a lower compartment 100 and an upper compartment 102. A horizontal wall 104 separates the two compartments and an opening 106 provides communication between the upper compartment 102 and the lower compartment 100. A movable valve means which is responsive to the level of liquid within the lower compartment, such as a floating ball 108, is provided to seal the opening 106 when the lower compartment 100 is nearly filled with liquid. The floating ball valve 108 is captured within a suitable housing 110 to operate in the known manner. Other types of liquid level responsive valves may be used.

The U tube 82 opens into the lower compartment 100 while the bypass conduit 90 attached to nipple 96 communicates with the upper compartment 102. A discharge tube 112 is connected between a discharge port 114 in the upper compartment and an opening 116 in the wash tub 14. The discharge port 114 is positioned very close to the horizontal wall 104 to prevent any liquid build-up in the upper compartment.

As the lower compartment 100 of the additive chamber 78 fills with wash liquid, the floating ball 108 will seal the opening 106 preventing additional liquid from entering the lower compartment. This causes the liquid to flow through the bypass conduit 90, through the upper compartment 102 and out through the discharge port 114 into the tub 14 by means of conduit 112.

The top end 98 of the rinse additive chamber 78 is open and a funnel member 118 is secured to the recessed portion 74 of the upper cabinet wall 34 and protrudes therethrough such that a large open mouth 122 of the funnel is positioned above the wall 74 and a narrow nozzle portion 124 extends through the wall 74 and communicates with the interior of the rinse additive chamber 78. The nozzle is positioned above the opening 106 in the horizontal separation wall 104 between the upper and lower compartments and the additive is directed through opening 106 into the lower compartment.

Although three chambers are described, and specific additives assigned to each chamber, it should be understood that any suitable number of chambers can be utilized as required by the application in which the dispensing system is used. Likewise, the types of additives introduced in each of the chambers can be modified as needed.

FIG. 6 shows in detail the pump 24 which is used in the dispensing system of the present invention. The pump 24 is comprised of a housing 126 which has three exterior communication openings. A first opening 128 communicates with the recirculation conduit 26 which in turn communicates with the interior of the tub 14. A second opening 130 communicates with the drain line conduit 28 and a third opening 132 communicates with the tap line 30.

The housing 126 encloses an impeller 134 which pumps water in both clockwise and counterclockwise directions of rotation as shown in FIG. 6. There is a first flow path area 136 within the pump housing 126 between the first opening 128 and the impeller 134. There is a second flow path area 138 within the pump housing between the second opening 130 and the impeller 134. There is a third flow path area 140 within the pump housing 126 which nearly encircles the impeller.

An interior wall 142 separates the first flow path area 136 from the second flow path area 138. A port 144 through the separation wall 142 allows communication between the two flow path areas 136, 138. A flapper check valve 146 is arranged to pivot on a pin 148 to open or close the port 144 depending on the water pressure within the two flow path areas 136, 138. If the pressure in flow path area 136 is greater than that in area 138, the flapper valve 146 will be caused to open thereby providing communication between the two flow path areas. However, if the pressure within flow path area 138 is greater than the pressure within area 136, the flapper valve is caused to close the port 144 thereby preventing communication between the two flow path areas.

Opening 132, which communicates with flow path area 140, is selectively opened or closed by a valve member 150 which is operated by a solenoid 152 through a linkage 154. An appropriate electrical signal is supplied on line 156 from controls 41 to cause the solenoid to operate the valve 150 as desired.

The operation of the dispensing system in the automatic washer proceeds as follows. Selected wash additives are introduced into the proper chambers prior to the initiation of the wash cycle. Detergent, whether liquid or powder, is introduced through the open top of the detergent chamber 42 when the machine lid 36 is in the open position. Similarly, if bleach is desired in the wash cycle, it is supplied to the bleach additive dispensing chamber 52 by means of the funnel type opening 70. Also, any desired rinse additive can be supplied to the rinse additive dispensing chamber 78 through funnel opening 118. The desired wash cycle program is selected by operating control knobs 40, a clothes load is introduced into the interior of the wash basket 16 and the lid 36 is closed. The remainder of the wash cycle is automatic.

The valve 150 controlling port 132 is normally in a closed position preventing wash liquid from entering tap line 30. If the user has selected a "prewash" cycle, after the machine has filled to a proper level of wash liquid, the prewash cycle is conducted and completed prior to the regular wash cycle.

During the regular wash cycle, the pump impeller 134 rotates in a counterclockwise direction and the solenoid 152 is energized to cause the valve member 150 to move away from port 132 thereby opening that port providing communication between flow path area 140 and tap line 30. The rotation of the pump impeller 134 causes a lower pressure in flow path area 138 than in flow path area 136 resulting in flapper valve 146 opening and providing communication between areas 136 and 138.

The wash liquid in flow path 140 is caused to move in a counterclockwise direction along with the rotation of the impeller 134 and thus wash liquid is pulled down through conduit 26 and inlet 128, into flow path area 136 and through port 144 into flow path area 138 and around flow path area 140 through discharge port 132 and into tap line 30. The wash liquid in tap line 30 proceeds up to the dispensing chambers and is routed directly into the detergent dispensing chamber 42 through U tube 44 and along conduit 54 and U tube 56 into bleach dispenser chamber 52 and along conduit 80 and U tube 82 into rinse additive dispensing chamber 78.

As detergent dispensing chamber 42 fills with wash liquid, the detergent is dissolved in the wash liquid. As the liquid level rises toward the top of the detergent dispensing chamber 42 it flows out through spout opening 50 directly into the wash basket 16. Wash liquid continues to flow into chamber 42 and the detergent is completely flushed from the chamber and is dispensed into the interior of the wash basket 16.

Wash liquid entering the bleach dispensing chamber 52 dilutes the bleach and rises to a level within the dispensing chamber where the liquid overflows into the bleed line conduit 62 and is directed into the wash tub 14. The diluted bleach enters the tub and is further diluted in the wash liquid before it enters the interior of the wash basket 16. Wash liquid continues to enter the bleach dispensing chamber 52 through conduit 54 flushing all of the bleach out of the chamber.

Wash liquid enters the rinse dispensing chamber 78 by means of conduit 80 and U tube 82. As the level of wash liquid in the rinse additive dispenser rises, it dilutes the rinse additive and as it nears the top of the lower compartment 110, it causes the floating ball valve 108 to rise and seal opening 106 between the upper and lower compartments. When opening 106 has been sealed, liquid is diverted through U tube leg 88 and through bypass conduit 90 directly into the upper compartment 102 thereby flushing any rinse additive from the upper compartment which has collected when the rinse additive was poured in through the funnel member 118. The bypass wash liquid enters the discharge port 114 and travels by conduit 112 into the wash tub 14.

Before the spin cycle starts, the solenoid 152 is deenergized by automatic operation of the sequential timing control 40 causing the valve 150 to close port 132. During the spin cycle, valve member 150 remains closed and conduits 30, 54 and 80 remain filled with wash liquid. Also, the liquid levels within each of the chambers remains at a maximum height, just below the outlets directed back to the tub or basket.

During the spin cycle, the pump impeller 134 is rotated in the clockwise direction which causes a lower pressure in flow path area 136 than in flow path area 138. This results in flapper valve 146 pivoting to a closed position preventing communicaton through opening 144 between areas 136 and 138. Wash liquid is drawn through conduit 26 and inlet 128, through flow path area 136, around area 140 and through area 138 to be directed to the drain through discharge outlet 130 and conduit 28. The pump and its interior selectively openable port means thus allows the wash liquid to flow from said inlet and to follow the impeller rotation in either direction in flow path area 140.

After the spin portion of the wash cycle and during the rinse fill period of the cycle, the solenoid 152 is again energized causing the valve 150 to open. The pump 24 is stopped and the impeller 134 is not rotating at this time. Since the liquid levels within the chambers are above the liquid level within the tub and basket, the liquid drains from each of the chambers through the U tubes which operate as siphon tubes removing essentially all of the liquid from each of the chambers. The liquid in the detergent dispensing chamber and the bleach dispensing chamber comprises regular wash liquid while the liquid in the rinse additive dispensing chamber includes the charge of rinse additive which has been diluted.

The liquid from the three chambers is drained through conduit 30 into the pump housing 126 since the level of liquid within the tub is low at the beginning of the rinse fill period of the cycle. The rinse additive blends with the wash liquid in the pump and lower tub area during the rinse fill period. Enough movement of the wash liquid occurs between the tub and pump areas to thoroughly mix the rinse additive throughout the wash liquid. The solenoid 152 is then deenergized to again close valve 150 for the remainder of the wash cycle. Thus, the chambers of the dispensing system are flushed and drained prior to the end of the cycle.

The present invention thus provides a pump for an automatic washer which has an inlet 128 from the machine tub 14 and a first outlet 132 to a set of dispensers and a second outlet 130 to drain, and including a check valve 146 between the inlet and the second outlet such that when the pump 24 is rotated in a first direction, liquid is drawn from the tub 14 through the check valve and pumped by the impeller 134 to the first outlet 132 which, if opened by the solenoid controlled valve 150, allows flow of liquid to the dispensers, and rotation of the impeller in the second direction closes the check valve 146 to allow the flow of liquid from the machine tub out the second outlet 130 to the drain.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. In an automatic washer connectable to a drain and having a receptacle for receiving wash liquid and clothes to be washed and a sequential control means for operating said washer through a washing cycle, a pumping system for said wash liquid comprising:

a dispensing means for dispensing a wash additive into said receptacle, said dispenser actuated by a flow of liquid;

a pump means for pressurizing a supply of wash liquid, and having an inlet connected to the receptacle, a first outlet connected to said dispensing means, a second outlet connected to said drain and a port between said inlet and said second outlet;

a motor for driving said pump means in first and second directions of rotation;

a first valve means in said pump means for controlling the flow of liquid through said first outlet, said first valve means normally biased to close said first outlet, said sequential control means operable to operate said valve means to open said first outlet; and a second valve means controlling the flow of liquid through said port, said second valve means actuated to an open position by the rotation of said pump means in said first direction and to a closed position sealing said port by the rotation of said pump means in a second direction, whereby driving said pump in said first direction and operation of said first valve means pumps wash liquid to said dispensing means to dispense a wash additive into said receptacle, and driving said pump means in said second direction pumps said wash liquid from said receptacle to said drain.

2. In a pump having a bi-directional rotatable impeller operable to pump liquid in a first and second direction and a pump housing, an inlet, a first outlet and second outlet, selectively openable port means interior of said pump housing allowing liquid flow from said inlet to follow said impeller rotation in either direction, selectively operable valve means on said first outlet to allow wash liquid to discharge from said outlet, whereby liquid can be pumped from said inlet to said first outlet by said pump operating in a first direction and from said inlet to said second outlet by said pump operating in a second direction.

3. The device of claim 2 including a flapper means operable by liquid pressure within said pump housing to control said openable port means.

4. The device of claim 2 wherein said operable valve means is comprised of a solenoid operated valve controlling said first outlet.

5. A system for dispensing a plurality of additives to a bath of liquid connectable to a drain comprising:

a container for holding said liquid;

a plurality of chambers for holding said additives;

a pump housing containing a pump having a rotating impeller operable in two directions of rotation;

said pump housing having an inlet and a first and second outlet;

conduits connecting said container with said pump housing at said inlet, said chambers with said pump housing at said first outlet, and said drain with said pump housing at said second outlet;

valve means in said pump housing responsive to pressures within said pump housing to provide fluid flow path to said impeller from said inlet in either direction of rotation;

valve means in said pump housing adjacent to said first outlet to control liquid flow between said pump and said chambers;

at least one chamber arranged to receive liquid from said pump and to overflow directly into said tub;

at least one chamber arranged to receive liquid from said pump until said chambers is filled and means arranged to cause excess liquid to bypass said chamber; and means associated with each chamber to selectively cause any liquid within said chambers to flow back into said pump housing when said impeller is stationary.

6. A dispensing system for an automatic washer having a receptacle for receiving wash liquid and clothes to be washed and connectable to a drain comprising:

a pump housing containing a pump having a rotating impeller operable in two directions of rotation;

said pump housing having an inlet and a first and second outlet;

at least one chamber for holding an additive to be dispensed into said receptacle;

conduits connecting said receptacle with said pump housing at said inlet, said chamber with said pump housing at said first outlet, and said drain with said pump housing at said second outlet;

means in said pump responsive to liquid pressures within said pump housing to provide fluid flow to said impeller in either direction of rotation; and valve means adjacent to said first outlet to control liquid flow between said pump and said chamber, whereby rotating said impeller in said first direction and operation of said valve means pumps wash liquid to said dispensing chamber to dispense said wash additive into said receptacle, and rotating said impeller in said second direction pumps said wash liquid from said receptacle to said drain.

7. The device of claim 6 wherein said dispensing chamber is arranged to receive a charge of additive through an open top, said additive being dissolved by wash liquid entering said chamber from said pump, said chamber having an overflow spout arranged to dispense excess wash liquid and additive from said chamber into said receptacle as said liquid continuously enters said chamber to flush said additive into said receptacle.

8. The device of claim 7 wherein said additive is a detergent.

9. The device of claim 7 wherein said additive is a bleach.

10. A device of claim 6 wherein said dispensing chamber has an open top arranged to receive a charge of additive, said additive being dissolved by wash liquid entering said chamber from said conduit from said pump, said chamber being divided into an upper compartment and a lower compartment with said liquid diluting said additive in said lower compartment, means to divert excess liquid flow from said pump to said upper compartment and into said tub when said lower compartment is filled, and means to selectively cause said liquid from said lower compartment to flow into said pump housing when said impeller is stationary.

11. In a dispensing system connectable to a drain, a pump housing containing a pump used in connection with a dispensing chamber wherein said pump housing contains an inlet, a first and second outlet, a rotating impeller operable to pump liquid in a first and second direction, a selectively operable port means interior of said pump housing to permit liquid flow from said inlet in two directions within said pump housing around said impeller, selectively operable valve means at said first outlet, conduit means connecting said first outlet with said dispensing chamber, and conduit means connecting said second outlet with said drain, whereby liquid can be pumped from said inlet to said dispensing chamber when said impeller is rotating in said first direction and from said drain when said impeller is rotating in said second direction.

* * * * *